US007014529B1

(12) United States Patent
Kubota et al.

(10) Patent No.: US 7,014,529 B1
(45) Date of Patent: Mar. 21, 2006

(54) SUBSTRATE PROCESSING METHOD AND SUBSTRATE PROCESSING APPARATUS

(75) Inventors: Takeo Kubota, Yokohama (JP); Atsushi Shigeta, Fujisawa (JP); Gen Toyota, Uita (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/036,137

(22) Filed: Jan. 18, 2005

(30) Foreign Application Priority Data

Oct. 15, 2004 (JP) ..... 2004-301749

(51) Int. Cl.
*B24B 49/14* (2006.01)

(52) U.S. Cl. ..... 451/7; 451/53; 451/168; 451/303

(58) Field of Classification Search ..... 451/303, 451/7, 53, 44, 449, 488, 168
See application file for complete search history.

(56) References Cited

U.S. PATENT DOCUMENTS 5,669,804 A * 9/1997 Takahashi et al. ..... 451/59
5,733,181 A * 3/1998 Hasegawa et al. ..... 451/168
6,000,997 A * 12/1999 Kao et al. ..... 451/7
6,478,879 B1 * 11/2002 Jackson ..... 134/7
6,837,773 B1 * 1/2005 Brunelli ..... 451/7

FOREIGN PATENT DOCUMENTS

| | | |
|---|---|---|
| JP | 05-329759 | 12/1993 |
| JP | 8-1494 | 1/1996 |
| JP | 08-118226 | 5/1996 |
| JP | 09-076148 | 3/1997 |

* cited by examiner

*Primary Examiner*—George Nguyen
(74) *Attorney, Agent, or Firm*—Finnegan, Henderson, Farabow, Garrett & Dunner, L.L.P.

(57) ABSTRACT

A substrate processing apparatus polishes a to-be-polished portion of a semiconductor substrate with a polishing tape. Part of the polishing tape is heated in advance. Part of the polishing tape is deformed conforming to a shape of the to-be-polished portion. Part of the deformed polishing tape is brought into contact with the to-be-polished portion of the substrate. The substrate and polishing tape are moved relative to each other.

20 Claims, 5 Drawing Sheets

SUBSTRATE PROCESSING METHOD AND SUBSTRATE PROCESSING APPARATUS

CROSS-REFERENCE TO RELATED APPLICATIONS

This application is based upon and claims the benefit of priority from prior Japanese Patent Application No. 2004-301749, filed Oct. 15, 2004, the entire contents of which are incorporated herein by reference.

BACKGROUND OF THE INVENTION

1. Field of the Invention

The present invention relates to a substrate processing method and substrate processing apparatus for polishing the notched portion or the like of a semiconductor substrate with a polishing tape.

2. Description of the Related Art

Conventionally, to polish the notched portion of a semiconductor wafer, a polishing tape with abrasive grains is brought into contact with the notched portion, and is slid in a direction perpendicular to the wafer surface (Jpn. Pat. Applin. KOKAI Publication No. 9-76148).

With this method, depending on the polishing conditions, the wafer may be damaged or the notched portion may be ground nonuniformly. This is due to the following reason. Although the polishing tape is curved along the notched portion by the polishing load, depending on the polishing conditions, the edge of the polishing tape catches on the notched portion. If the polishing tape deforms insufficiently, the area of that portion of the polishing tape which is in contact with the polishing surface becomes narrow. Then, stable polishing cannot be performed easily. In this case, it is difficult to perform uniform polishing, and the entire surface of the polishing tape is not used, which is uneconomical.

If the polishing conditions are not inappropriate in this manner when polishing the notched portion, the edge of the polishing tape may damage the wafer, or uniform polishing cannot be performed. To conform the polishing tape to the shape of the notched portion, the polishing tape may be made thin. When the polishing tape is made thin, however, durability against pulling suffers. Therefore, to thin the polishing tape is limited.

BRIEF SUMMARY OF THE INVENTION

According to one aspect of the present invention, there is a substrate processing method comprising: heating part of a polishing tape in advance which is to polish a to-be-polished portion of a semiconductor substrate, to deform part of the polishing tape in accordance with a shape of the to-be-polished portion; and bringing the deformed part of the polishing tape into contact with the to-be-polished portion of the substrate and moving the substrate and polishing tape relative to each other, to polish the to-be-polished portion.

According to another aspect of the present invention, there is further a substrate processing method comprising: heating part of a polishing tape which is to be brought into contact with a notched portion formed on a peripheral portion of a semiconductor substrate, to curve part of the polishing tape in a widthwise direction in conformity to a shape of the notched portion; and bringing the curved part of the polishing tape into contact with the notched portion of the substrate and moving the polishing tape in a direction intersecting a surface of the substrate, to polish the notched portion.

According to still another aspect of the present invention, there is still further a substrate processing apparatus comprising: a heating mechanism which heats part of a polishing tape served for polishing a to-be-polished portion of a semiconductor substrate, to deform part of the polishing tape in conformity to a shape of the to-be-polished portion of the substrate; a contact mechanism which brings the deformed part of the polishing tape into contact with the to-be-polished portion of the substrate; and a moving mechanism which moves the substrate and polishing tape relative to each other.

DETAILED DESCRIPTION OF THE INVENTION

An embodiment of the present invention will be described with reference to the accompanying drawings.

First Embodiment

Figure 1:
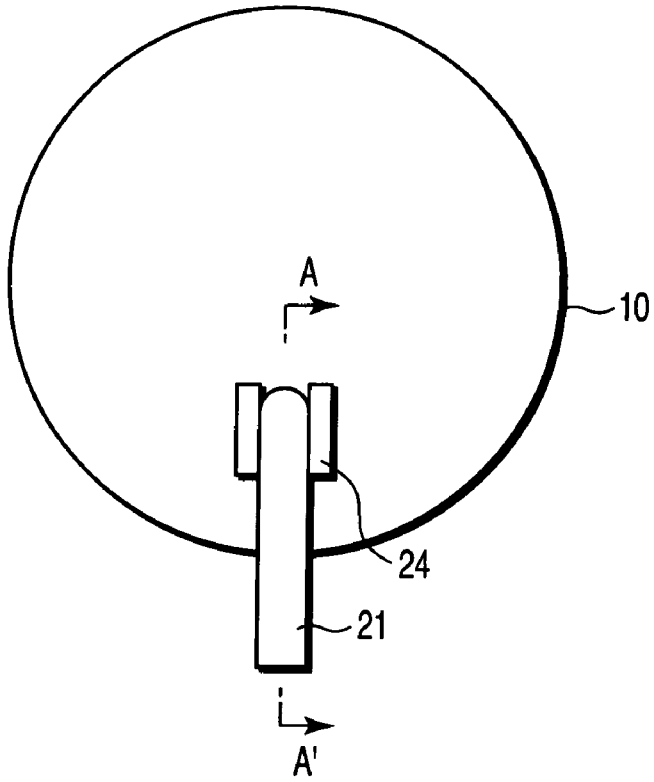
FIG. 1 is a plan view showing the schematic structure of a substrate processing apparatus according to the first embodiment.
Figure 2:
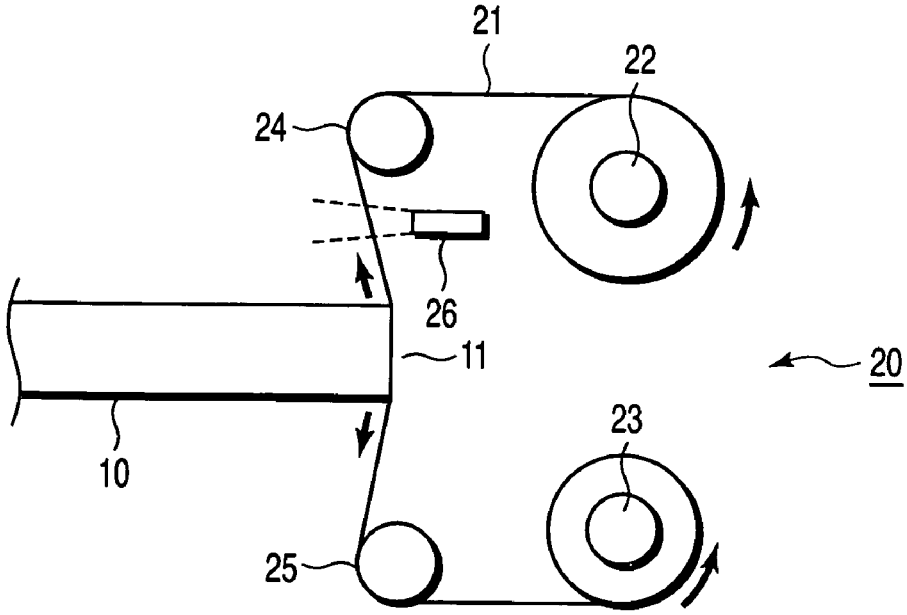
FIG. 2 is a sectional view showing the schematic structure of the substrate processing apparatus according to the first embodiment.

FIGS. 1 and 2 explain the schematic structure of a substrate processing apparatus according to the first embodiment of the present invention, in which FIG. 1 is a plan view, and FIG. 2 is a sectional view seen from the direction of arrows A–A' of FIG. 1.

A semiconductor wafer 10 is held on a stage (not shown) in a horizontal direction. A polishing mechanism 20 to polish a notched portion 11 of the wafer 10 is provided.

The polishing mechanism 20 includes a polishing tape 21, supply roller 22, take-up roller 23, supply guide roller 24, take-up guide roller 25, and cooling water nozzle 26. Abrasive grains are attached to the polishing tape 21. The supply roller 22 supplies the polishing tape 21. The take-up roller 23 takes up the polishing tape 21. The polishing tape 21 is supplied from the supply roller 22, guided by the guide rollers 24 and 25, and taken up by the take-up roller 23.

Between the guide rollers 24 and 25, the polishing tape 21 is applied with a predetermined tension, and is simultaneously against the notched portion 11 of the semiconductor wafer 10. The polishing mechanism 20 entirely moves in the vertical direction while the polishing tape 21 is in contact with the notched portion 11 of the wafer 10.

Figure 3:
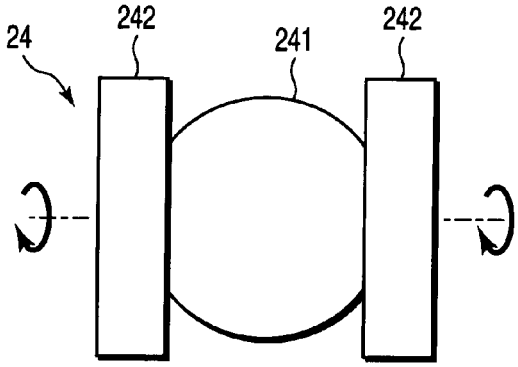
FIG. 3 is a sectional view showing the shape of the guide surface of a guide roller used in the first embodiment.

The guide roller 24 is a stainless-steel guide roller incorporating a heater. The guide surface of the guide roller 24 is not flat but is curved, as shown in the sectional view of FIG. 3. More specifically, the surface of a guide portion 241 sandwiched by two flanges 242 projects in accordance with the shape of the recess of the notched portion 11. The polishing tape 21 is abutted in a heated state against the guide surface of the curved guide portion 241. When the polishing tape 21 passes on the guide roller 24, it is curved in the widthwise direction. More specifically, when the polishing tape 21 passes on the guide roller 24, it is curved such that its section in the widthwise direction is arcuate. The cooling water nozzle 26 is disposed under the guide roller 24, to cool the heated, curved polishing tape 21. At this time, the curved state of the polishing tape 21 is maintained, and the shape of the polishing tape 21 is further stabilized by cooling.

Figure 4:
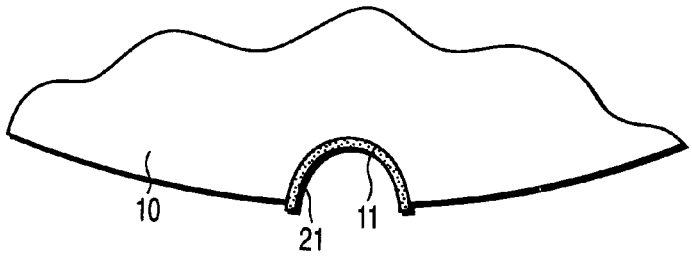
FIG. 4 is a sectional view showing the contact state of the notched portion of a wafer and a polishing tape in the first embodiment.

When the polishing tape 21 is curved in this manner, the polishing tape 21 curved in the widthwise direction comes into contact with the entire surface of the notched portion 11 of the semiconductor wafer 10 uniformly, as shown in the sectional view of FIG. 4. In this state, the polishing mechanism 20 is moved in the vertical direction to polish the notched portion 11 uniformly with the polishing tape 21.

The polishing tape 21 is taken up in the following manner. First, the polishing tape 21 is curved for a predetermined length in the above manner. The curved portion is brought into contact with the notched portion 11 of the semiconductor wafer 10. The polishing mechanism 20 vibrates to polish the notched portion 11. After the polishing is performed for a predetermined period of time, the polishing tape 21 is taken up by a predetermined amount, and a newly supplied portion of the polishing tape 21 is curved in the manner as described above. Then, the new portion of the polishing tape 21 comes into contact with the notched portion 11 of the semiconductor wafer 10. This process is repeated so that the polishing tape 21 is constantly in contact with the notched portion 11 with its new portion.

While polishing the notched portion 11 by the vibration of the polishing mechanism 20, the polishing tape 21 may be continuously fed little by little. In this case, the polishing need not to be stopped when taking up the polishing tape 21.

In this embodiment, as the polishing tape 21, one obtained by adhering #4000 diamond abrasive grains to a PET (PolyEthylene Terephthalate) resin member having a thickness of 50 $\mu$m thickness and a width of 8 mm is used. Polishing is performed while maintaining the temperature of the guide roller 24 at 80° C. and feeding the polishing tape 21 continuously at a speed of 10 mm/min. The cooling water nozzle 26 sprays pure water of 15° C. to that portion of the polishing tape 21 which has passed the guide roller 24, to cool this portion. Thus, the polishing tape 21 reaches a polishing portion while maintaining its shape deformed by the heated guide roller 24. A pulling tension is applied to each of the tape feed side and take-up side, and a 1-kgf load is applied to the notched portion 11 while pushing in the polishing tape 21. The polishing mechanism 20 is vertically vibrated 30 times per min to perform polishing.

As a result, the notched portion 11 can be polished well without being damaged by the polishing.

In this manner, according to this embodiment, the guide roller 24 provided with the heater and having the curved guide surface is used to abut the polishing tape 21 in the heated state against the guide roller 24. Thus, before the polishing, the polishing tape 21 can be curved conforming to the curvature of the notched portion 11 of the semiconductor wafer 10. Therefore, the polishing tape 21 comes into contact with the entire surface of the notched portion 11 uniformly. Accordingly, the notched portion 11 of the semiconductor wafer 10 is not easily damaged by the polishing, and high-speed polishing can be performed uniformly.

According to this embodiment, the polishing tape 21 is curved not only with a mechanical pressure but also while applying heat to it. Thus, the physical damage to be applied to the polishing tape 21 can be decreased. The polishing tape 21 is heated so that it can be curved easily. Thus, as the polishing tape 21, one having a large thickness or one having a high rigidity can be used. The polishing tape having a high rigidity is effective in polishing the notched portion 11 uniformly. The polishing tape having a high rigidity or the polishing tape having a large thickness is appropriate if it is not to be disposed but to be reused after it is taken up by the take-up roller 23.

Second Embodiment

Figure 5:
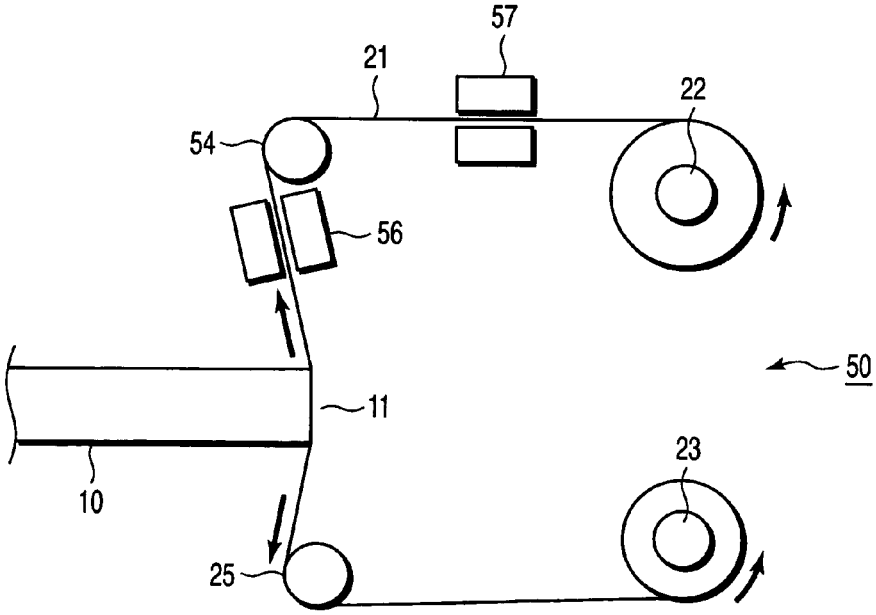
FIG. 5 is a sectional view showing the schematic structure of the substrate processing apparatus according to the second embodiment.

FIG. 5 is a sectional view showing the schematic structure of a substrate processing apparatus according to the second embodiment of the present invention. The same portions as in FIG. 2 are denoted by the same reference numerals, and a detailed description thereof will be omitted.

The second embodiment is different from the first embodiment described above in the structure of a polishing mechanism 50, and in that a polishing tape 21 is heated not by a guide roller 24 but by an independently provided heater. More specifically, a warm-air heater 57 is set before a heater-less guide roller 54. A blower 56 to blow cold air to the polishing tape 21 is set between the guide roller 54 and a semiconductor wafer 10. The guide roller 54 has a curved guide surface in the same manner as the guide roller 24 shown in FIG. 3.

In this structure, as the polishing tape 21, one obtained by adhering #4000 diamond abrasive grains to a PET resin member having a thickness of 50 $\mu$m thickness and a width of 8 mm is used. Before the polishing tape 21 enters the tape-supply guide roller 54, the warm-air heater 57 blows hot air of 90° C. to soften the polishing tape 21. The polishing tape 21 is deformed by the guide roller 54 in conformity to the shape of a notched portion 11. The blower 56 set between the guide roller 54 and wafer 10 blows cold air of 5° C. to cool the polishing tape 21 while maintaining the shape of the polishing tape 21. After this, the notched portion 11 is polished with the same polishing operation as that in the first embodiment.

In the second embodiment, the polishing tape 21 is curved conforming to the shape of the notched portion 11, in the same manner as in the first embodiment. Thus, the polishing tape 21 can be brought into contact with the entire surface of the notched portion 11 uniformly. As a result, the same effect as that of the first embodiment can be obtained.

Third Embodiment

Figure 6:
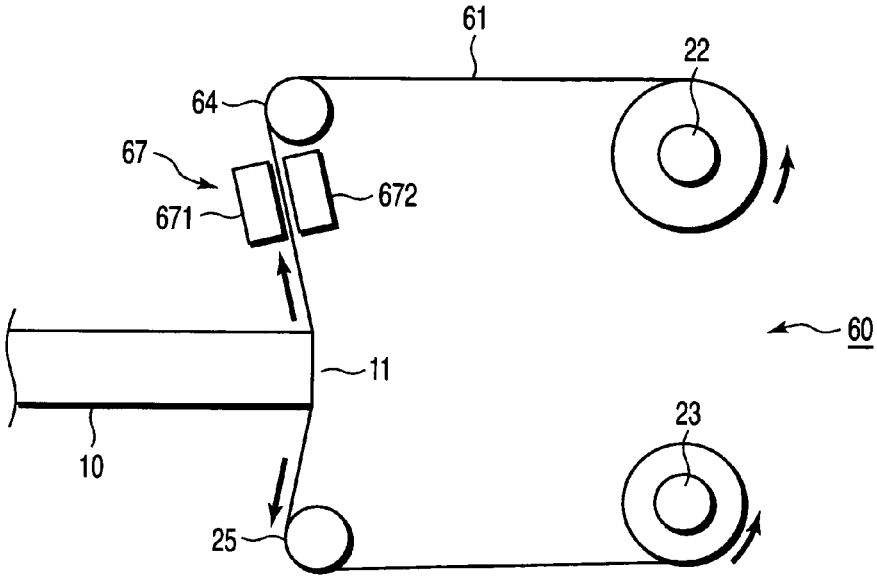
FIG. 6 is a sectional view showing the schematic structure of a substrate processing apparatus according to the third embodiment.

FIG. 6 is a sectional view showing the schematic structure of a substrate processing apparatus according to the third embodiment of the present invention. The same portions as in FIG. 2 are denoted by the same reference numerals, and a detailed description thereof will be omitted.

The basic structure of the third embodiment is the same as that of the first or second embodiment. In the third embodiment, the structure of a polishing tape 61 is devised so that the polishing tape 61 curves by itself.

In a polishing mechanism 60 according to this embodiment, a supply guide roller 64 has a flat guide surface, in the same manner as an ordinary guide roller. A lamp heater 67 is set between the guide roller 64 and a semiconductor wafer 10. The heater 67 is divided into an front-surface heater 671 and back-surface heater 672 that can be set to different temperatures.

Figure 7:
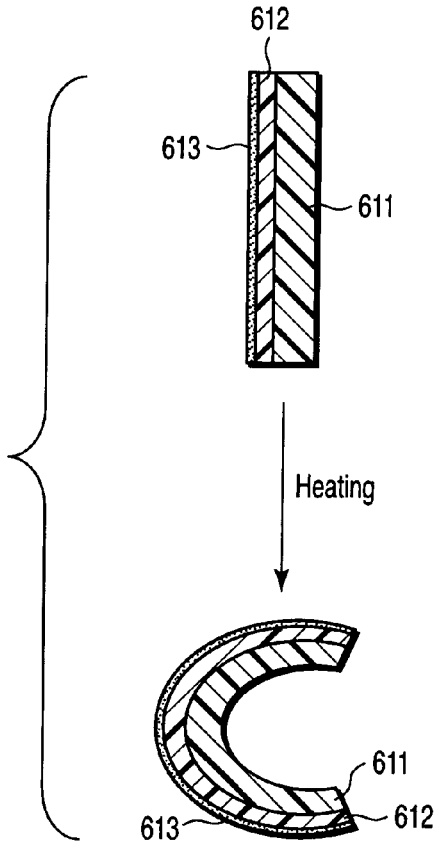
FIG. 7 is a sectional view showing the structure of a polishing tape used in the third embodiment and a state wherein the polishing tape is deformed by heating.

The polishing tape 61 is formed of two resins 611 and 612 having different materials and abrasive grains 613, as shown in the upper portion of FIG. 7. The resins 611 and 612 are stacked on each other, and the abrasive grains 613 are attached to the surface of the resin 612.

As the front-surface-side resin 612 to which the abrasive grains 613 are attached, a material that can stretch easily by heat is used. As the back-surface-side resin 611, a material that does not stretch easily (or shrinks) by heat as compared to the front-surface-side resin 612 is used. For example, the front-surface-side resin 612 is a PET (PolyEthylene Terephthalate) resin, and the back-surface-side resin 611 is a crosslinked soft polyolefin resin.

In this arrangement, the preset temperature of the front-surface heater 671 is set higher than that of the back-surface heater 672. For example, the heaters 671 and 672 are set to 180° C. and 120° C., respectively. Then, the front-surface-side resin 612 stretches more largely than the back-surface-side resin 611. Thus, the polishing tape 61 deforms to a shape conforming to the shape of a notched portion 11, as shown in the lower portion of FIG. 7. Namely, the polishing tape 61 can be curved along the longitudinal direction such that its section in the widthwise direction (a direction taken along a surface perpendicular to the longitudinal direction) is arcuate.

When heating the polishing tape 61, its front surface side and back surface side may be heated to the same temperature. If a temperature difference is formed between the front and back surface sides, the polishing tape 61 can be curved largely. After this, the notched portion 11 is polished with the same polishing operation as that of the first embodiment.

In this manner, according to the third embodiment, the two types of resins 611 and 612 having different thermal expansion coefficients are used as the base material of the polishing tape 61. Thus, the polishing tape 61 can be curved by only heating it. In the third embodiment, the polishing tape 61 can accordingly be brought into contact with the entire surface of the notched portion 11 uniformly in the same manner as in the first embodiment described above. The same effect as that of the first embodiment can be obtained.

Fourth Embodiment

Figure 8:
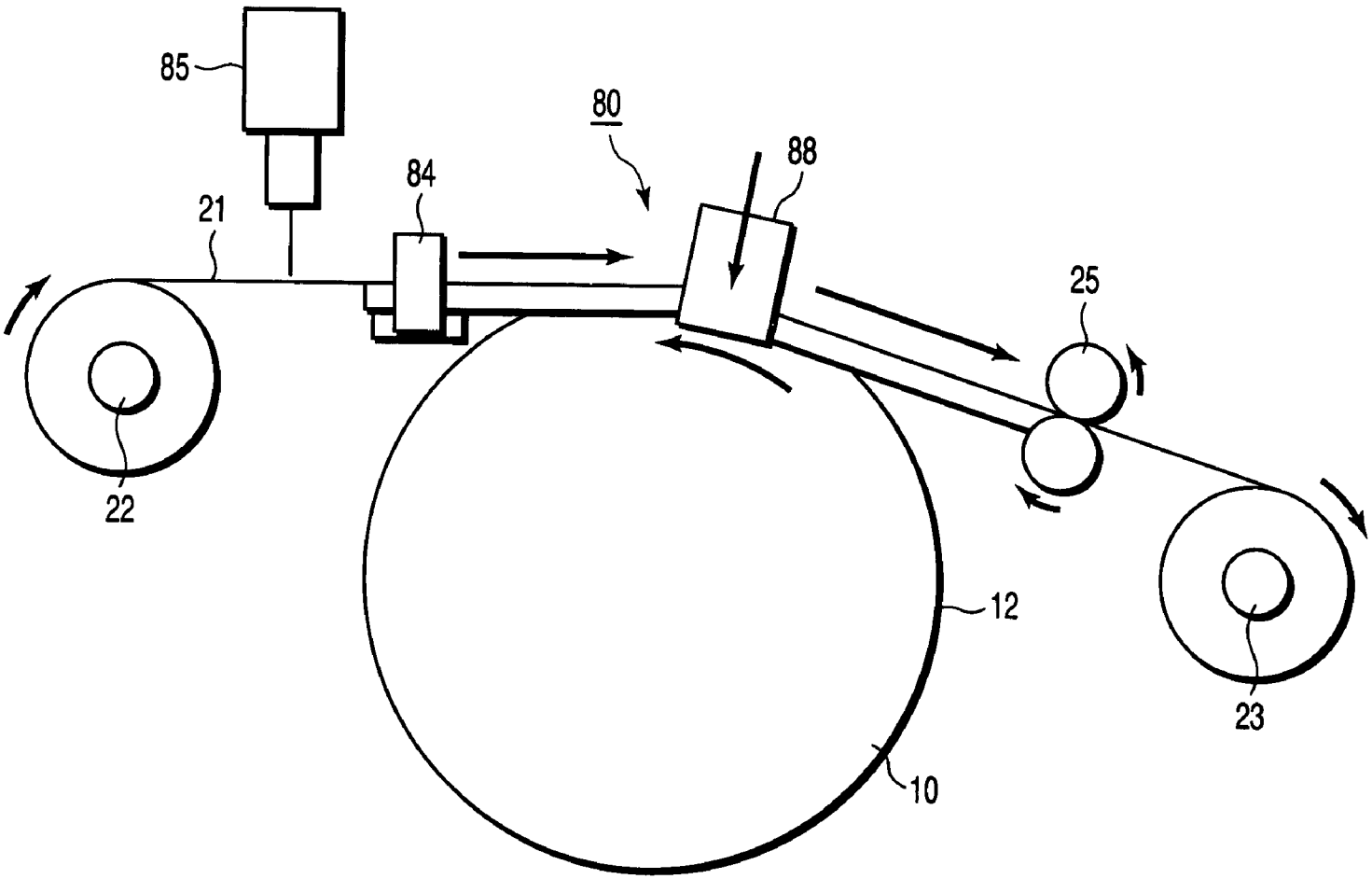
FIG. 8 is a plan view showing the schematic structure of a substrate processing apparatus according to the fourth embodiment.

FIG. 8 is a plan view showing the schematic structure of a substrate processing apparatus according to the fourth embodiment of the present invention. In this embodiment, the bevel portion as the peripheral portion of a wafer is to be polished.

A semiconductor wafer 10 is held on a rotary stage (not shown). A polishing mechanism 80 to polish a bevel portion 12 of the wafer 10 is provided.

The polishing mechanism 80 includes a polishing tape 21, supply roller 22, take-up roller 23, supply guide portion 84, take-up guide roller 25, polishing head 88, and laser generator 85. Abrasive grains are attached to the polishing tape 21. The supply roller 22 supplies the polishing tape 21. The take-up roller 23 takes up the polishing tape 21. The polishing tape 21 is supplied by the supply roller 22, guided by the guide portion 84 and guide roller 25, and taken up by the take-up roller 23. The semiconductor wafer 10 rotates together with the stage with the polishing tape 21 being in contact with the bevel portion 12 of the wafer 10.

Figure 9A:
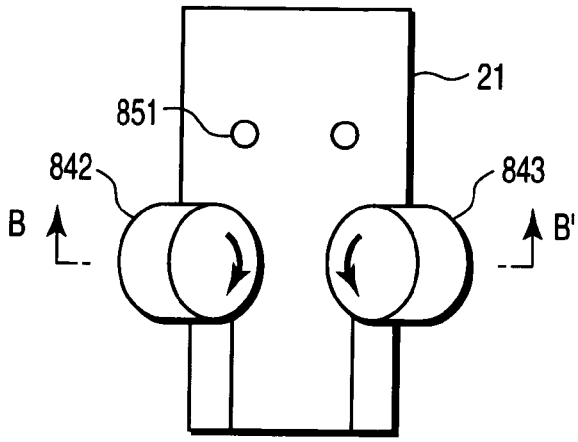
FIG. 9A is a plan view showing the structure of a guide portion used in the fourth embodiment.
Figure 9B:
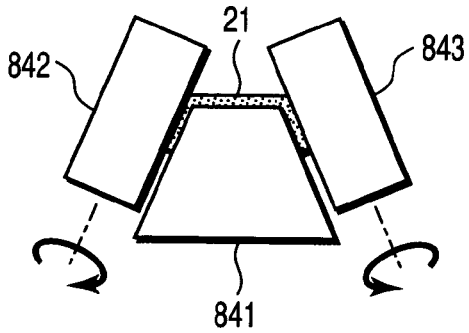
FIG. 9B is a sectional view showing the structure of the guide portion used in the fourth embodiment.

The guide portion 84 includes a trapezoidal guide body 841 and circular cylindrical rollers 842 and 843, as shown in FIGS. 9A and 9B. FIG. 9A is a plan view, and FIG. 9B is a sectional view seen from the direction of arrows B–B' of FIG. 9A. The rollers 842 and 843 are arranged along the side wall of the guide body 841. The polishing tape 21 is guided along the upper surface of the guide body 841, and urged against the side surface of the guide body 841 by the rollers 842 and 843. The laser generator 85 is set between the guide portion 84 and supply roller 22. The laser generator 85 emits a laser beam 851 to irradiate the target curving region of the polishing tape 21, thus heating the region. Then, the polishing tape 21 can be curved easily.

Figure 10:
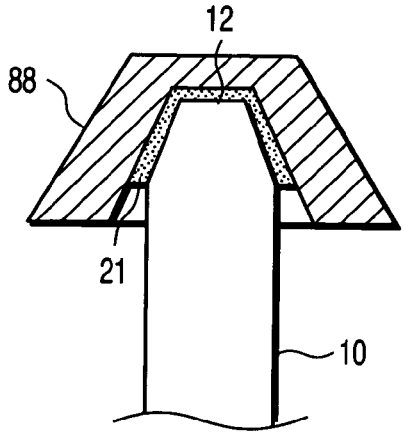
FIG. 10 is a sectional view showing the contact state of the bevel portion of a wafer and a polishing tape in the fourth embodiment.

In this structure, the target curving portion of the polishing tape 21 supplied from the supply roller 22 is heated by the laser generator 85. As the polishing tape 21 passes on the guide portion 84, the polishing tape 21 is deformed into the same shape as the section of the bevel portion 12 of the wafer 10. The polishing tape 21 is urged against the bevel portion 12 by that portion of the polishing head 88 which is in contact with the bevel portion 12 of the wafer 10. As shown in FIG. 10, the polishing tape 21 comes into contact with the entire surface (end face and upper and lower inclined surfaces) of the bevel portion 12 uniformly. In this state, the wafer 10 is rotatably driven, so that its bevel portion 12 can be polished well. The polishing tape 21 which serves for polishing is restored flat by the guide roller 25, and is taken up by the take-up roller 23.

According to this embodiment, the polishing is performed by urging the polishing tape 21 against the bevel portion 12 of the wafer 10, which rotates at 500 rpm, with a load of 1 kgf while the polishing tape 21 is continuously fed at a speed of 10 mm/min. Thus, the bevel portion 12 of the wafer 10 can be polished well.

In this manner, according to this embodiment, the polishing tape 21 is deformed conforming to the bevel portion 12 of the semiconductor wafer 10. Thus, the polishing tape 21 comes into the entire surface of the bevel portion 12 uniformly. Damages will not be easily formed by polishing, and high-speed, uniform polishing can be performed. In addition, the end face and the upper and lower inclined surfaces of the bevel portion 12 can be polished simultaneously. The polishing time can thus be further shortened.

(Modification)

The present invention is not limited to the embodiments described above. The target polishing portion is not necessarily limited to the notched portion or bevel portion of the semiconductor wafer, but can be any portion that can be polished through contact with the polishing tape. When heating the polishing tape, a temperature difference may be formed between the front and back surfaces of the tape, or between the central and end portions of the tape. The material and heating temperature of the polishing tape can be appropriately changed depending on the specifications.

When polishing the notched portion of the semiconductor wafer, the sliding direction of the polishing tape is not necessarily limited to a direction perpendicular to the substrate surface, but may be inclined from the direction perpendicular to the substrate surface. In the embodiments, to heat part of the polishing tape, the polishing tape is brought into contact with a heated member (guide roller). A high-temperature gas is blown to the polishing tape by using a warm-air heater. Alternatively, the polishing tape is irradiated with a laser beam by using a laser generator. However, the present invention is not limited to these measures. A high-temperature liquid may be blown from a nozzle or the like to part of the polishing tape. Furthermore, according to the embodiments, to cool part of the polishing tape, cooling water is blown from the nozzle to the tape. However, the present invention is not limited to this. A low-temperature gas may be blown to the tape. Alternatively, the tape may be brought into contact with a cooled member.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A substrate processing method comprising:

heating part of a polishing tape in advance which is to polish a to-be-polished portion of a semiconductor substrate, to deform part of the polishing tape in accordance with a shape of the to-be-polished portion; and bringing the deformed part of the polishing tape into contact with the to-be-polished portion of the substrate and moving the substrate and polishing tape relative to each other, to polish the to-be-polished portion.

2. A method according to claim 1, wherein to deform part of the polishing tape, a guide roller which incorporates a heater and a guide surface of which that abuts against the polishing tape is curved is used, and the polishing tape is heated and curved along the guide surface.

3. A method according to claim 2, wherein part of the polishing tape which is curved through the guide roller is cooled before being brought into contact with the to-be-polished portion of the substrate.

4. A method according to claim 1, wherein to deform part of the polishing tape, a guide roller a guide surface of which that abuts against the polishing tape is curved is used, and the polishing tape is heated by a heater before the guide roller, to curve part of the polishing tape along the guide surface of the guide roller.

5. A method according to claim 4, wherein part of the polishing tape which is curved through the guide roller is cooled after the guide roller.

6. A method according to claim 1, wherein to deform part of the polishing tape, a tape base material obtained by adhering two types of resin materials having different thermal expansion coefficients is used, and part of the polishing tape is curved by heating.

7. A method according to claim 1, wherein the polishing tape includes abrasive grains held on a resin-made base material.

8. A method according to claim 1, wherein to heat part of the polishing tape, one of high-temperature liquid and gas is blown to the tape, the tape is irradiated with a light beam, or the tape is brought into contact with a heated member.

9. A method according to claim 1, wherein when heating part of the polishing tape, a temperature gradient is formed between front and back surfaces or between central and end portions of the polishing tape.

10. A substrate processing method comprising:

heating part of a polishing tape which is to be brought into contact with a notched portion formed on a peripheral portion of a semiconductor substrate, to curve part of the polishing tape in a widthwise direction in conformity to a shape of the notched portion; and bringing the curved part of the polishing tape into contact with the notched portion of the substrate and moving the polishing tape in a direction intersecting a surface of the substrate, to polish the notched portion.

11. A method according to claim 10, wherein to curve part of the polishing tape, a guide roller which incorporates a heater and a guide surface of which that abuts against the polishing tape is curved is used, and the polishing tape is heated and curved along the guide surface.

12. A method according to claim 11, wherein part of the polishing tape which is curved through the guide roller is cooled before being brought into contact with the notched polished portion of the substrate.

13. A method according to claim 10, wherein to curve part of the polishing tape, a guide roller a guide surface of which that abuts against the polishing tape is curved is used, and the polishing tape is heated by a heater before the guide roller, to curve part of the polishing tape along the guide surface of the guide roller.

14. A method according to claim 13, wherein part of the polishing tape which is curved through the guide roller is cooled after the guide roller.

15. A method according to claim 10, wherein to curve part of the polishing tape, a tape base material obtained by adhering two types of resin materials having different thermal expansion coefficients is used, and part the polishing tape is curved by heating.

16. A method according to claim 10, wherein the polishing tape includes abrasive grains held on a resin-made base material.

17. A method according to claim 10, wherein to heat part of the polishing tape, one of high-temperature liquid and gas is blown to the tape, the tape is irradiated with a light beam, or the tape is brought into contact with a heated member.

18. A method according to claim 10, wherein when heating part of the polishing tape, a temperature gradient is formed between front and back surfaces or between central and end portions of the polishing tape.

19. A substrate processing apparatus comprising:

a heating mechanism which heats part of a polishing tape served for polishing a to-be-polished portion of a semiconductor substrate, to deform part of the polishing tape in conformity to a shape of the to-be-polished portion of the substrate;

a contact mechanism which brings the deformed part of the polishing tape into contact with the to-be-polished portion of the substrate; and a moving mechanism which moves the substrate and polishing tape relative to each other.

20. An apparatus according to claim 19, wherein the to-be-polished portion of the substrate is a notched portion, the contact mechanism brings the polishing tape into contact with the notched portion such that an elongated direction of the polishing tape is substantially perpendicular to a surface of the substrate, and the moving mechanism reciprocally moves the polishing tape in the elongated direction.

* * * * *

UNITED STATES PATENT AND TRADEMARK OFFICE

CERTIFICATE OF CORRECTION

PATENT NO. : 7,014,529 B1
APPLICATION NO. : 11/036137
DATED : March 21, 2006
INVENTOR(S) : Kubota et al.

It is certified that error appears in the above-identified patent and that said Letters Patent is hereby corrected as shown below:

Title page,
Item [75], Inventors, change "Uita" to -- Oita --.

Column 8,
Line 35, change "part the" to -- part of the --.

Signed and Sealed this

Twenty-seventh Day of June, 2006

JON W. DUDAS
*Director of the United States Patent and Trademark Office*